US005722763A

United States Patent [19]

Chen

[11] Patent Number: 5,722,763

[45] Date of Patent: Mar. 3, 1998

[54] LANTERN

[76] Inventor: Kao-San Chen, No. 282, Sec. 2, Shu-Lin St., Tainan City, Taiwan

[21] Appl. No.: 724,181

[22] Filed: Sep. 30, 1996

[51] Int. Cl.[6] ..... F21L 19/02

[52] U.S. Cl. ..... 362/163; 362/180; 362/181; 362/314; 362/316; 431/291

[58] Field of Search ..... 431/291; 362/161–163, 362/171–173, 178, 180, 182, 312, 313, 314, 316, 445, 447

[56] References Cited

U.S. PATENT DOCUMENTS

| | | | |
|---|---|---|---|
| 105,762 | 7/1870 | Young | 362/161 |
| 543,691 | 7/1895 | Kennedy et al. | 362/161 |
| 978,172 | 12/1910 | Lenne | 362/180 |
| 4,181,927 | 1/1980 | Garcia | 362/163 |

FOREIGN PATENT DOCUMENTS

| | | | |
|---|---|---|---|
| 92752 | 7/1897 | Germany | 362/163 |
| 292088 | 5/1916 | Germany | 362/163 |

*Primary Examiner*—Alan Cariaso

*Attorney, Agent, or Firm*—Morgan & Finnegan, L.L.P.

[57] ABSTRACT

A lantern includes a base which has a bottom wall with a ventilation hole unit formed therethrough, and a surrounding wall. The bottom wall has a bottom surface in which an accommodating recess and an open-ended holder positioning slot unit are formed. The recess and the positioning slot unit are communicated with each other. A clamp member is fixed on the base and has at least three clamping pieces. A candlestick is clamped among the clamping pieces and is adapted to mount a candle thereon. A vertical tubular transparent shade has two open ends and is disposed on the surrounding wall. A top cover is attached to a top end of the shade and is provided with a hanging unit. The top cover has two opposed horizontal positioning holes formed in an outer surface thereof. An elongated and generally U-shaped holder has a horizontal rod which extends through the positioning slot unit and which is movable vertically. Two vertical rods are respectively and integrally formed with the horizontal rod and are respectively inserted into the positioning holes so as to hold the top cover and the shade on the base. A resilient element is disposed within the accommodation recess so as to push the horizontal rod downward relative to the base, thus clamping the shade between the top cover and the base.

6 Claims, 6 Drawing Sheets

LANTERN

BACKGROUND OF THE INVENTION

1. Field of the Invention

This invention relates to a lantern, more particularly to a lantern with a base and a top cover which are interconnected by a holder and a resilient element to improve safety in use, the resilient element being concealed in the base without affecting the outer appearance of the lantern.

2. Description of the Related Art

Referring to FIG. 1, a conventional lantern 1 is shown to comprise a base 11 which has a circular plate 111, a surrounding wall 112 extending upwardly from the circular plate 111, and a plurality of supporting feet 113 extending downwardly from the circumference of the plate 111 for supporting the plate 111. The top end of the surrounding wall 112 is formed with a shoulder 114 and a skirt portion 115. The outer wall of the skirt portion 115 has three engaging portions 116, each of which is provided with a transverse slot 117 and a projection 118 in the slot 117. The plate 111 has a central ventilation hole 119, a rim 110 which extends upwardly from the plate 111 around the ventilation hole 119, and a clamping member 12 mounted on the outside of the rim 110. The clamp member 12 has three clamp pieces 121 each of which forms a second shoulder 122 for placing a candlestick 13 thereon, and a flexible portion 123 extending upwardly from the second shoulder 122. For shielding the candle light of the candlestick 13 from the wind, a tubular cover member 14 is mounted on the base 11. The cover member 14 has a longitudinal passage 141, a transparent shade 15, a plurality of holders 142 extending inwardly from the cover member 14 for holding the transparent shade 15, three penetrating holes 143 formed in the cover member 14, and a top cover 16 on the top end of the cover member 14. For fastening the cover member 14 on the base 11 firmly, the inner wall of the cover member 14 is provided with three inwardly pressed protrusions 144 which are adjacent to its bottom end so as to be engaged within the transverse slots 117 of the base 11 and so as to be hindered by the projections 118 from disengaging the slots 117. A hooked hanger 17 is mounted on the cover member 14.

In use, the candle in the candlestick 13 is lighted. The candlestick 13 is clamped on the clamping pieces 121 of the clamp member 12. The cover member 14 is mounted on the base 11 in such a manner that the protrusions 144 are inserted into the transverse slots 117 and are positioned by the projections 118, respectively, so as to be fixed on the base 11. Although the lantern 1 can be hung conveniently, it has a disadvantage in that the base 11, the candlestick 13 and the cover member 14 are held together by only the protrusions 144 and the projections 118. The protrusions 144 and the projections 118 are subject to wear after long-term use, thus separating the base 11 from the cover member 14 and resulting in danger.

SUMMARY OF THE INVENTION

Therefore, the objective of the present invention is to provide a lantern with a base and a top cover which are interconnected be a holder and a resilient element which can overcome the aforementioned problem commonly associated with the prior art. The resilient element is concealed in the base without affecting the outer appearance of the lantern.

According to this invention, a lantern includes a base which has a bottom wall with a ventilation hole unit formed therethrough, and a surrounding wall. The bottom wall has a bottom surface in which an accommodating recess and an open-ended holder positioning slot unit are formed. The recess and the positioning slot unit are communicated with each other. A clamp member is fixed on the base and has at least three clamping pieces. A candlestick is clamped among the clamping pieces and is adapted to mount a candle on the candlestick. A vertical tubular transparent shade has two open ends and is disposed on the surrounding wall. A top cover is attached to a top end of the shade and is provided with a hanging unit. The top cover has two opposed horizontal positioning holes formed in an outer surface thereof. An elongated and generally U-shaped holder has a horizontal rod which extends through the positioning slot unit and which is movable vertically. Two vertical rods are respectively and integrally formed with the horizontal rod and are respectively inserted into the positioning holes so as to hold the top cover and the shade on the base. A resilient element is disposed within the accommodation recess so as to push the horizontal rod downward relative to the base, thus clamping the shade between the top cover and the base. The top cover is capable of moving upward relative to the shade against biasing force of the resilient element in such a manner that the horizontal rod of the holder moves upward in the positioning slot unit of the base so as to rotate the holder about the horizontal rod and away from the shade, thereby permitting the shade to be removed from the base for access to the candlestick.

BRIEF DESCRIPTION OF THIS DRAWINGS

Other features and advantages of the present invention will become apparent in the following detailed description of a preferred embodiment of the invention, with reference to the accompanying drawings, in which.

DETAILED DESCRIPTION OF THE PREFERRED EMBODIMENT

Figure 1:
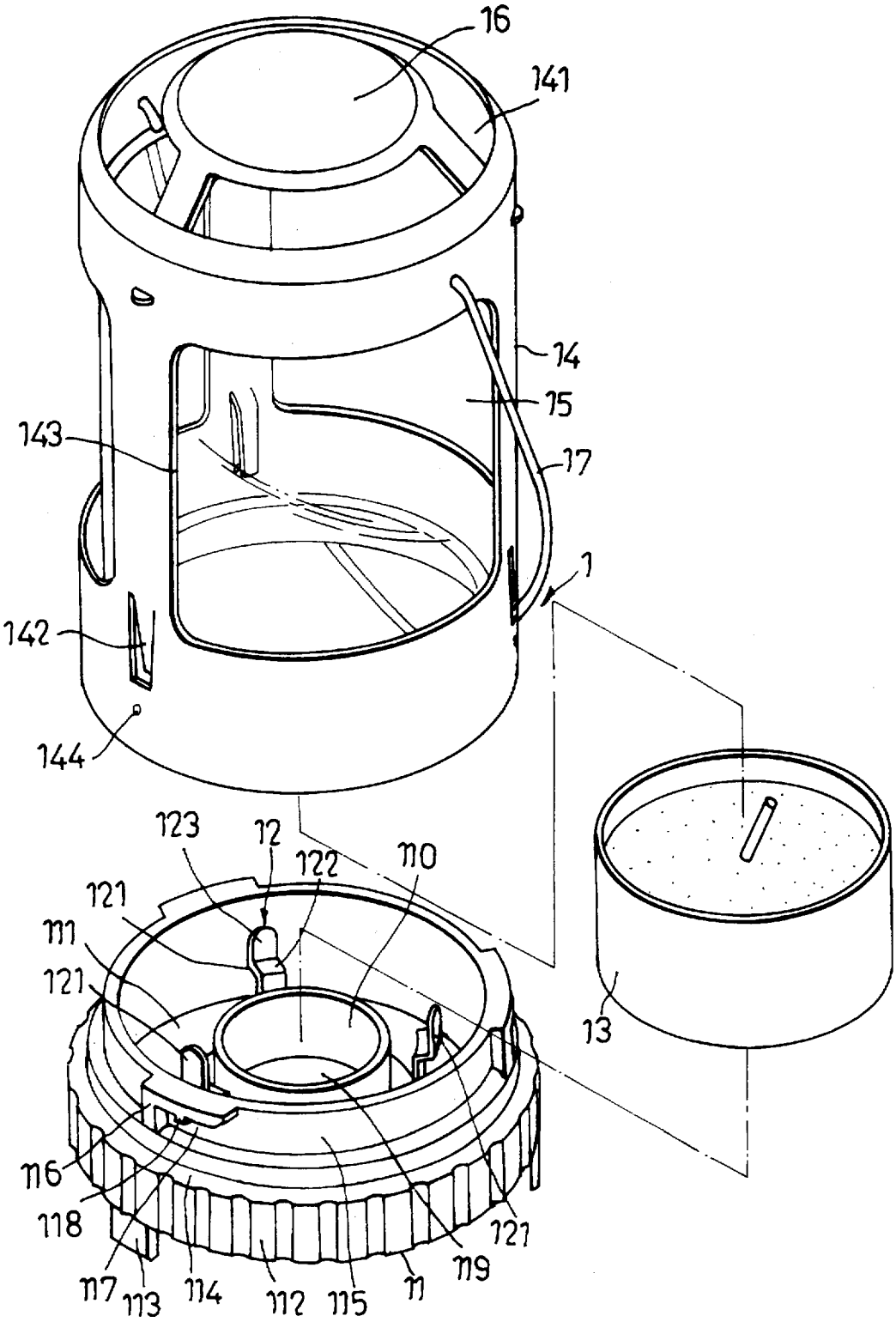
FIG.1 PRIOR ART
FIG. 1 is an exploded view of a conventional lantern.
Figure 2:
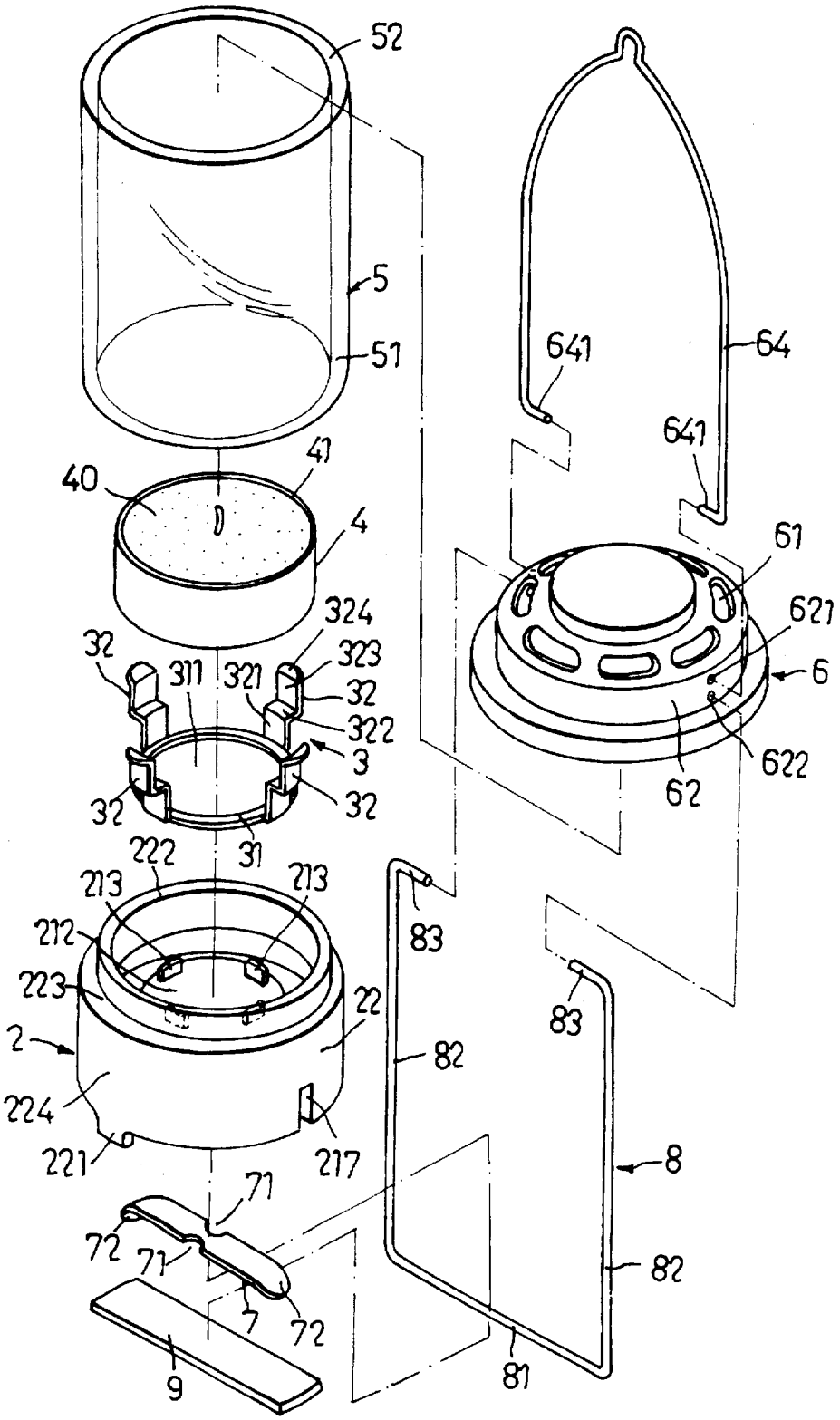
FIG. 2 is an exploded view of a lantern of a preferred embodiment according to this invention.
Figure 3:
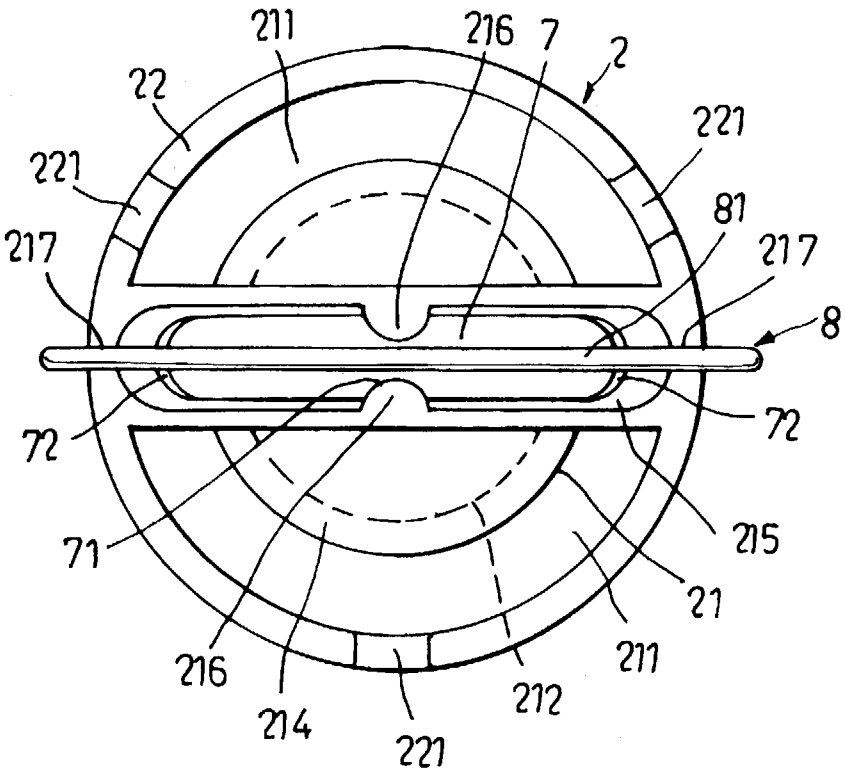
FIG. 3 is a bottom view of the preferred embodiment without a top cover of the lantern.

Referring to FIGS. 2 and 3, a lantern of a preferred embodiment according to this invention is shown to comprise a base 2, a clamp member 3, a candlestick 4, a vertical tubular transparent shade 5, a top cover 6, a resilient element 7, an elongated and generally U-shade holder 8, and a bottom cover 9.

The base 2 has a circular bottom wall 21 with a pair of curve ventilation holes 211 which are formed therethrough, and a surrounding wall 22 which is formed integrally with the outer periphery of the top surface of the bottom wall 21. The bottom wall 21 is formed with a circular platform 212 which has four supporting members 213 so as to define an annulus 214 between the platform 212 and the ventilation holes 211. The bottom wall 21 has a bottom surface in which a generally rectangular accommodating recess 215 and an open-ended holder-positioning slot unit consisting of two aligned slots 217 are formed. The recess 215 has two long sides near the middle portions of which a pair of fixed positioning posts 216 are formed on the bottom wall 21, and two short sides near which the slots 217 are formed through the surrounding wall 22 in communication with the recess 215. Three supporting feet 221 extend downwardly from the bottom wall 21. The surrounding wall 22 has a small-outer-diameter upper portion 222 and a large-outer-diameter lower portion 224 which has an outer diameter larger than that of the small-outer-diameter upper portion 222, thereby defining to define a shoulder 223 between the upper and lower portions 222, 224.

Figure 4:
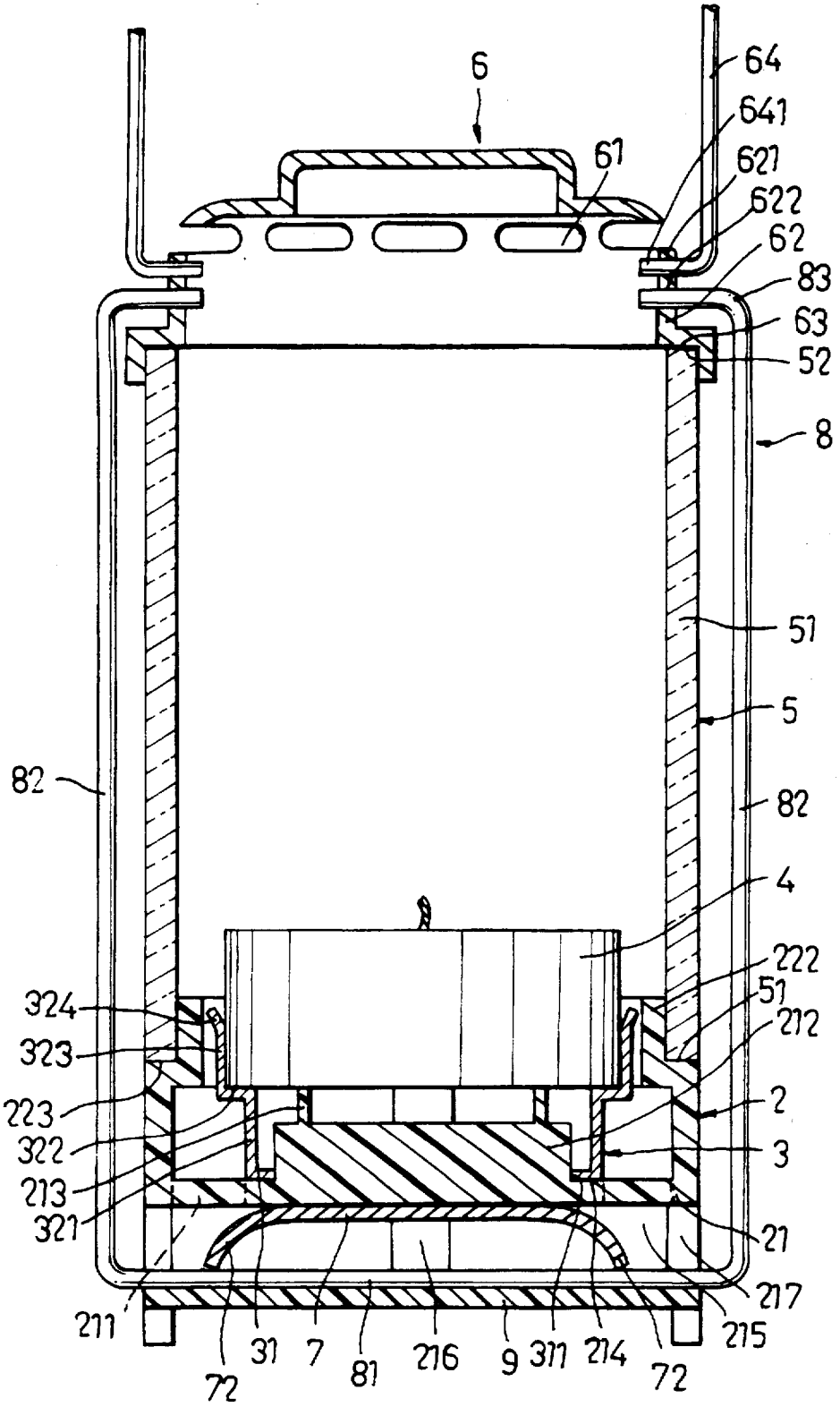
FIG. 4 is a sectional view of the preferred embodiment.

Referring to FIGS. 2 and 4, the clamp member 3 is fixed on the base 2. The clamp member 3 has a base ring 31 which has a central hole 311 and which rests on the annulus 214 of the bottom wall 21, and four clamping pieces 32 which extend integrally and upwardly from the ring 31. Each clamping piece 32 is unitary and has a vertical lower section 321, a vertical upper section 323, a horizontal intermediate section 322 which has an outer side coupled with the upper section 323 and an inner side coupled with the lower section 321, and an inclined section 324 which extends upwardly and outwardly from the upper section 323. The intermediate section 322 of each clamping piece 32 is level with the top ends of the supporting members 213 of the bottom wall 21.

The candlestick 4 is placed on the intermediate sections 322 and is clamped among the clamping pieces 32. The candlestick 4 has a container 41 adapted to mount a candle 40 thereon.

The shade 5 has an open lower end 51 which is sleeved on the base 2 in such a manner that the lower end 51 rests on the shoulder 223 of the surrounding wall 22 and is sleeved on the upper portion 222 of the surrounding wall 22, and an open top end 52.

The top cover 6 is sleeved on the top end 52 of the shade 5 and is provided with a plurality of ventilation holes 61, an outer surface 62 with a pair of opposed horizontal first positioning holes 621 and a pair of opposed horizontal second positioning holes 622, and a shoulder 63 which abuts on the top end 52 of the shade 5. A hanging unit 64 has two horizontal end sections 641 which extend inwardly into the first positioning holes 621, respectively.

The U-shade holder 8 has a horizontal rod 81 which extends through the positioning slots 217 and the center of the bottom wall 21 of the base 2 in such a manner that the horizontal rod 81 is movable vertically in the positioning slots 217, and two vertical rods 82 which are respectively and integrally formed with two ends of the horizontal rod 81 and which have horizontally and inwardly extending upper end sections 83 that are respectively inserted into the second positioning holes 622 of the top cover 6 so as to hold the top cover 6 and the shade 5 on the base 2.

Figure 5:
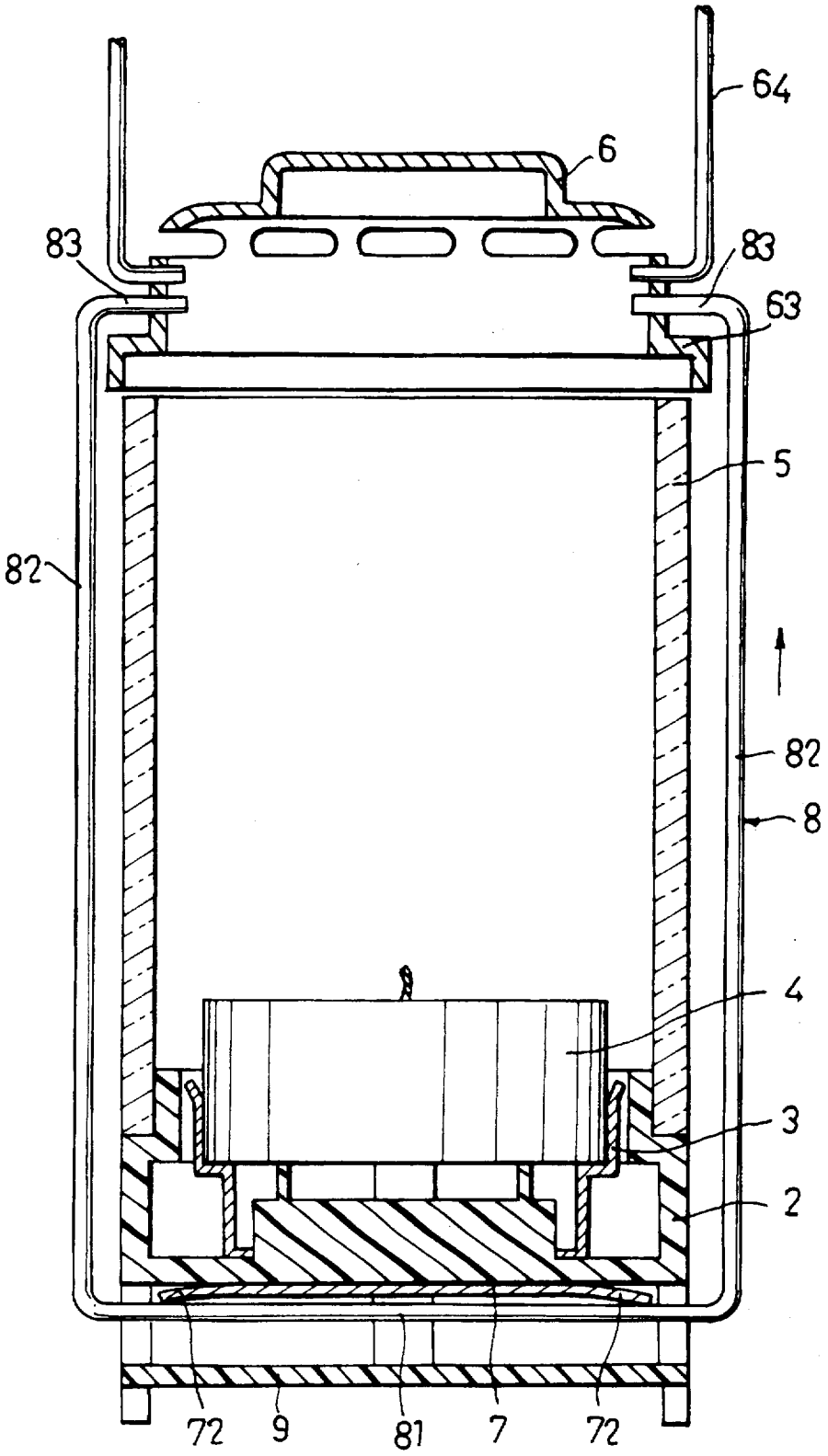
FIG. 5 is schematic view illustrating the action of a flexible member when the top cover is moved upwardly.

The resilient element 7 is disposed within the accommodation recess 215 of the base 2, and is an elongated generally horizontal reed spring. The reed spring has two notches 71 which are formed in two opposite sides thereof and which engage the positioning posts 216 so as to position the reed spring within the recess 215, and two downwardly inclined end sections 72 so as to push the horizontal rod 81 of the holder 8 downward relative to the base 2, thus clamping the shade 5 between the top cover 6 and the base 2. Referring to FIG. 5, the top cover 6 is capable of moving upward relative to the shade 5 against biasing force of the resilient element 7 in such a manner that the horizontal rod 81 of the holder 8 moves upward in the positioning slots 217 of the base 2, so as to rotate the holder 8 about the horizontal rod 81 and away from the shade 5, in a manner illustrated in FIG. 6, thereby permitting the shade 5 to be removed from the base 2 for access to the candlestick 4.

The bottom cover 9 is fixed on the base 2 to close the recess 215.

In use, the resilient element 7 can push the horizontal rod 81 of the holder 8 downward relative to the base 2, and the upper end sections 83 of the holder 8 are inserted into the second positioning holes 622 of the top cover 6. Therefore, the top cover 6 can be firmly mounted on the shade 5 to prevent the candlestick 4 from falling. Air can enter into the lantern via the ventilation holes 211.

Figure 6:
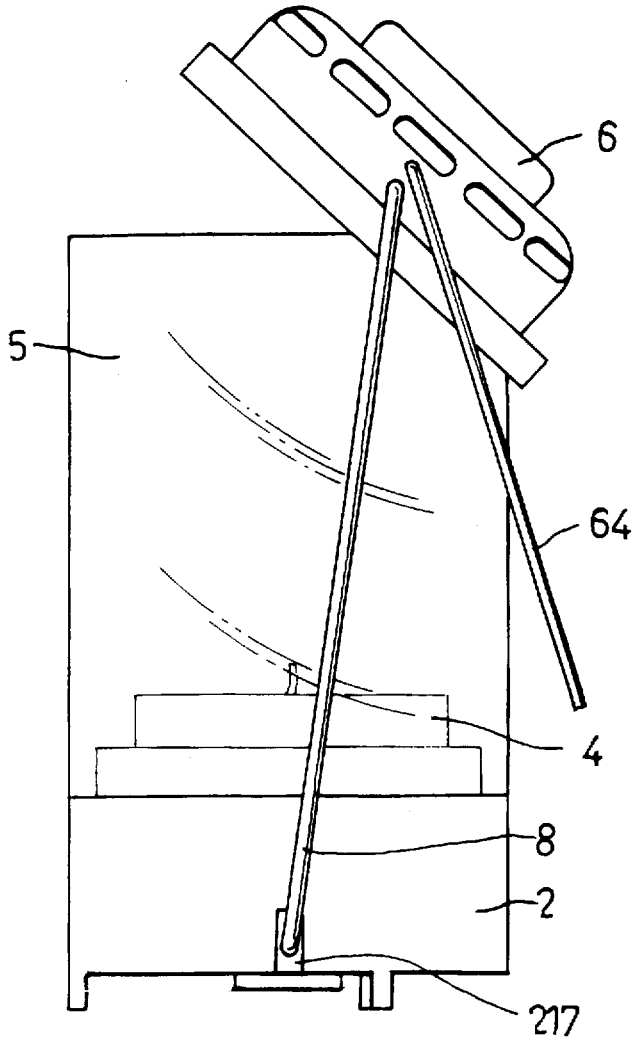
FIG. 6 is a schematic view illustrating how the top cover to be opened.

Referring to FIGS. 5 and 6, when it is desired to replace the candlestick 4, the top cover 6 is moved upwardly relative to the shade 5 against the biasing force of the resilient element 7. Then, the holder 8 is rotated about the horizontal rod 81 and away from the shade 5, thereby permitting the shade 5 to be removed from the base 2 for taking out the candlestick 4.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A lantern including:

a base having a bottom wall with a ventilation hole unit formed therethrough, and a surrounding wall formed integrally with an outer periphery of a top surface of said bottom wall;

a clamp member fixed on said base and having at least three clamping pieces which are formed integrally with one another;

a candlestick clamped among said clamping pieces and adapted to mount a candle on said candlestick;

a vertical tubular transparent shade having two open ends and disposed on said surrounding wall of said base in such a manner that one of a lower end of said shade and an upper end of said base is sleeved on the other one of the lower end of said shade and the upper end of said base; and a top cover attached to a top end of said shade and provided with a hanging unit;

wherein the improvements comprise:

said bottom wall of said base having a bottom surface in which an accommodating recess and an open-ended holder positioning slot unit are formed, said recess and said positioning slot unit being communicated with each other;

said top cover having two opposed horizontal positioning holes formed in an outer surface thereof;

an elongated and generally U-shaped holder having a horizontal rod extending through said positioning slot unit in such a manner that said horizontal rod is movable vertically in said positioning slot unit, and two vertical rods which are respectively and integrally formed with two ends of said horizontal rod and which have horizontally and inwardly extending upper end sections that are respectively inserted into said positioning holes of said top cover so as to hold said top cover and said shade on said base; and a resilient element disposed within said accommodation recess of said base so as to push said horizontal rod of said holder downward relative to said base, thus clamping said shade between said top cover and said base, said top cover being capable of moving upward relative to said shade against biasing force of said resilient element in such a manner that said horizontal rod of said holder moves upward in said positioning slot unit of said base so as to rotate said holder about said horizontal rod and away from said shade, thereby permitting said shade to be removed from said base for access to said candlestick.

2. A lantern as claimed in claim 1, wherein said surrounding wall of said base has a small-outer-diameter upper portion and a large-outer-diameter lower portion which has an outer diameter larger than that of said small-outer-diameter upper portion, thereby defining a shoulder between said upper and lower portions, the lower end of said shade being sleeved on said small-outer-diameter upper portion in such a manner that the lower end of said shade rests on said shoulder.

3. A lantern as claimed in claim 1, wherein each of said clamping pieces is unitary and has a vertical lower section, a vertical upper section and a horizontal intermediate section which has an outer side coupled with said upper section and an inner side coupled with said lower section.

4. A lantern as claimed in claim 1, wherein said bottom wall of said base is circular, said horizontal rod of said holder extending through center of said bottom wall.

5. A lantern as claimed in claim 1, wherein said resilient element is an elongated generally horizontal reed spring which has two downwardly inclined end sections, said accommodation recess of said base being rectangular.

6. A lantern as claimed in claim 5, wherein said recess has two long sides and two short sides, said base including two fixed positioning posts disposed in said recess near middle portions of said long sides, said reed spring having two notches which are formed in two opposite sides thereof and which engage said positioning posts so as to position said reed spring within said recess.

* * * * *